US008006591B2

(12) United States Patent
Fan

(10) Patent No.: US 8,006,591 B2
(45) Date of Patent: Aug. 30, 2011

(54) ADJUSTABLE WRENCH

(76) Inventor: Chen Jun Fan, Taichung (TW)

( * ) Notice: Subject to any disclaimer, the term of this patent is extended or adjusted under 35 U.S.C. 154(b) by 218 days.

(21) Appl. No.: 12/456,148

(22) Filed: Jun. 15, 2009

(65) Prior Publication Data

US 2010/0294085 A1 Nov. 25, 2010

(30) Foreign Application Priority Data

May 25, 2009 (TW) ..... 098209098

(51) Int. Cl.
*B25B 13/34* (2006.01)

(52) U.S. Cl. ..... 81/100; 81/111; 81/DIG. 9

(58) Field of Classification Search ..... 81/98–111, 81/DIG. 8, DIG. 9, 124.3, 124.6
See application file for complete search history.

(56) References Cited

U.S. PATENT DOCUMENTS 1,499,552 A * 7/1924 Reynolds ..... 81/111
1,754,717 A * 4/1930 Hughens ..... 81/98
3,661,041 A * 5/1972 Welz ..... 81/98
5,131,300 A * 7/1992 Daniel ..... 81/111
2010/0122610 A1* 5/2010 Chen ..... 81/111

* cited by examiner

*Primary Examiner* — Hadi Shakeri

(57) ABSTRACT

A adjustable wrench comprises a body used to operate the adjustable wrench including a fixed jaw extending outward therefrom and having a holder mounted on a top end thereof, including an arcuate recess fixed on a middle portion of a front side thereof; a movable jaw pivoted in the holder, serving as engaging a workpiece, and including a guiding rib relative to the arcuate recess extending from a bottom end thereof to be adjusted and moved along the arcuate recess; a locking mechanism axially displacing in the cavity of the body and including a control unit to operate the locking mechanism and to drive a pushing member, the control unit including locking and unlocking positions so as to move the pushing member across the notch of the arcuate recess and then to bias against the guiding rib, thereafter, the pushing member is driven to move downward, thus disengaging the guiding rib to slide freely.

11 Claims, 7 Drawing Sheets

ADJUSTABLE WRENCH

BACKGROUND OF THE INVENTION

1. Field of the Invention

The present invention relates to a hand tool, and more particularly to an adjustable wrench.

2. Description of the Prior Art

Conventional adjustable wrench can only be used to engage a single size of workpiece and can not be operated freely in a limited space.

The present invention has arisen to mitigate and/or obviate the afore-described disadvantages.

SUMMARY OF THE INVENTION

The primary object of the present invention is to provide an adjustable wrench that can be used to engage different sizes of workpiece.

Another object of the present invention is to provide an adjustable wrench that can engage the workpieces securely.

An adjustable wrench in accordance with the present invention comprises:

- a body used to operate the adjustable wrench and including a fixed jaw extending outward therefrom and having a polygonal first engaging surface formed on a lower side of the fixed jaw, and the fixed jaw including a holder mounted on a top end thereof, the body also including an arcuate recess with an inlet and an outlet fixed on a middle portion of a front side thereof and with a notch proximate to the outlet, and including a cavity adjacent to the notch;
- a movable jaw pivoted in the holder and including a polygonal second engaging surface formed on an inner wall thereof in response to the first engaging surface so as to engage a workpiece, and including a guiding rib relative to the arcuate recess extending from a bottom end thereof to be adjusted and moved along the arcuate recess;
- a locking mechanism axially displacing in the cavity of the body and including a control unit to operate the locking mechanism and to drive a pushing member, the control unit including locking and unlocking positions so as to move the pushing member across the notch of the arcuate recess and then to bias against the guiding rib, thereafter, the pushing member is driven to move downward, thus disengaging the guiding rib to slide freely.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Referring to FIGS. 1-5, an adjustable wrench according to a first embodiment of the present invention comprises a body 10, a movable jaw 20, and a locking mechanism 30, wherein

Figure 3:
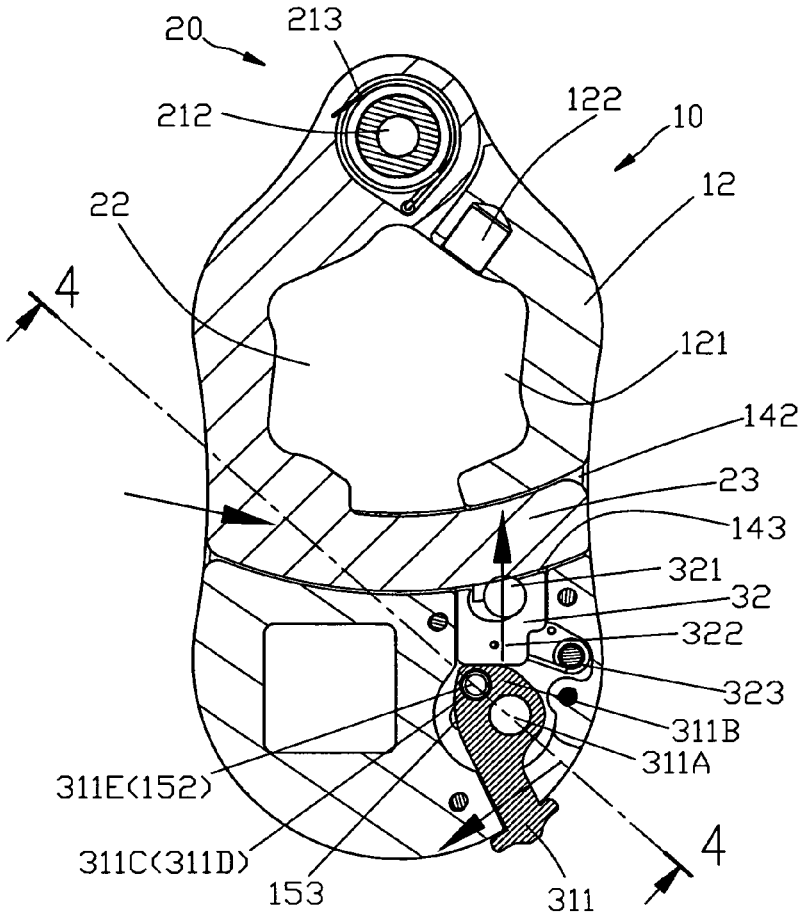
FIG. 3 is a cross sectional view showing the assembly of the adjustable wrench according to the first embodiment of the present invention.
Figure 4:
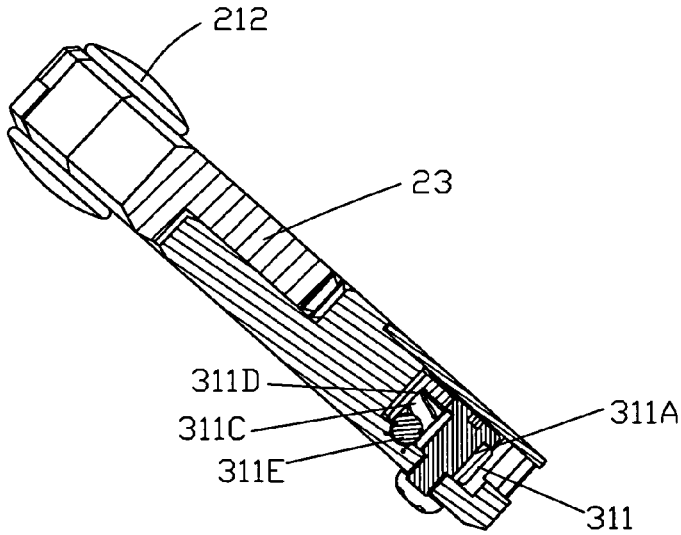
FIG. 4 is a cross sectional view taken along the line 4-4 of FIG. 3.

- the body 10 is used to operate the adjustable wrench and includes a through hole 11 disposed on a lower side thereof to insert a driving shank (not shown), includes a fixed jaw 12 extending outward therefrom and having a polygonal first engaging surface 121 formed on a lower side of the fixed jaw 12, the first engaging surface 121 includes at least one magnet 122 (as shown in FIG. 3) attached therein to attract a workpiece, and the fixed jaw 12 has a holder 13 with an opening 131 mounted on a top end thereof, the body 10 also includes an arcuate recess 14 with an inlet 141 and an outlet 142 fixed on a middle portion of a front side thereof and with a notch 143 proximate to the outlet 142, includes a cavity 15 adjacent to the notch 143, the cavity 15 includes an aperture 151 secured at a central portion thereof and first and second limiting orifices 152, 153 disposed thereon so as to form a 45 degree angle between the first and second limiting orifices 152, 153 relative to the aperture 151, thereby locking and unlocking the locking mechanism 30;
- the movable jaw 20 is pivoted in the holder 13 and includes an axial mount 21 having a bore 211 mounted on one end of the axial mount 21 to receive a shaft member 212 and a torsion spring 213, and includes a polygonal second engaging surface 22 formed on an inner wall thereof in response to the first engaging surface 121 so as to engage a workpiece, and includes a guiding rib 23 relative to the arcuate recess 14 extending from a bottom end thereof to be adjusted and moved along the arcuate recess 14;
- the locking mechanism 30 axially displaces in the cavity 15 of the body 10 and includes a control unit 31 to operate the locking mechanism 30 and to drive a pushing member 32, the control unit 31 includes a levering member 311 axially displacing in the cavity 15, a pivotal projection 311A pivoted in the aperture 151, a retaining plane 311B arranged around an outer side of the pivotal projection 311A, a positioning port 311C relative to the first and second limiting orifices 152, 153, a spring 311D and a positioning ball 311E;
- the pushing member 32 includes a biasing ball 321 received therein, an actuating portion 322 formed on a bottom side thereof to be pushed by the retaining plane 311B, and a first resilient element 323 retained therein, such that as the levering member 311 is levered, the biasing ball 321 of the pushing member 32 is actuated to move across the notch 143 of the arcuate recess 14 and then to bias against the guiding rib 23. Thereafter, the levering member 311 is levered upward to drive the pushing member 32 to move downward, thus disengaging the guiding rib 23 to slide freely.

Figure 1:
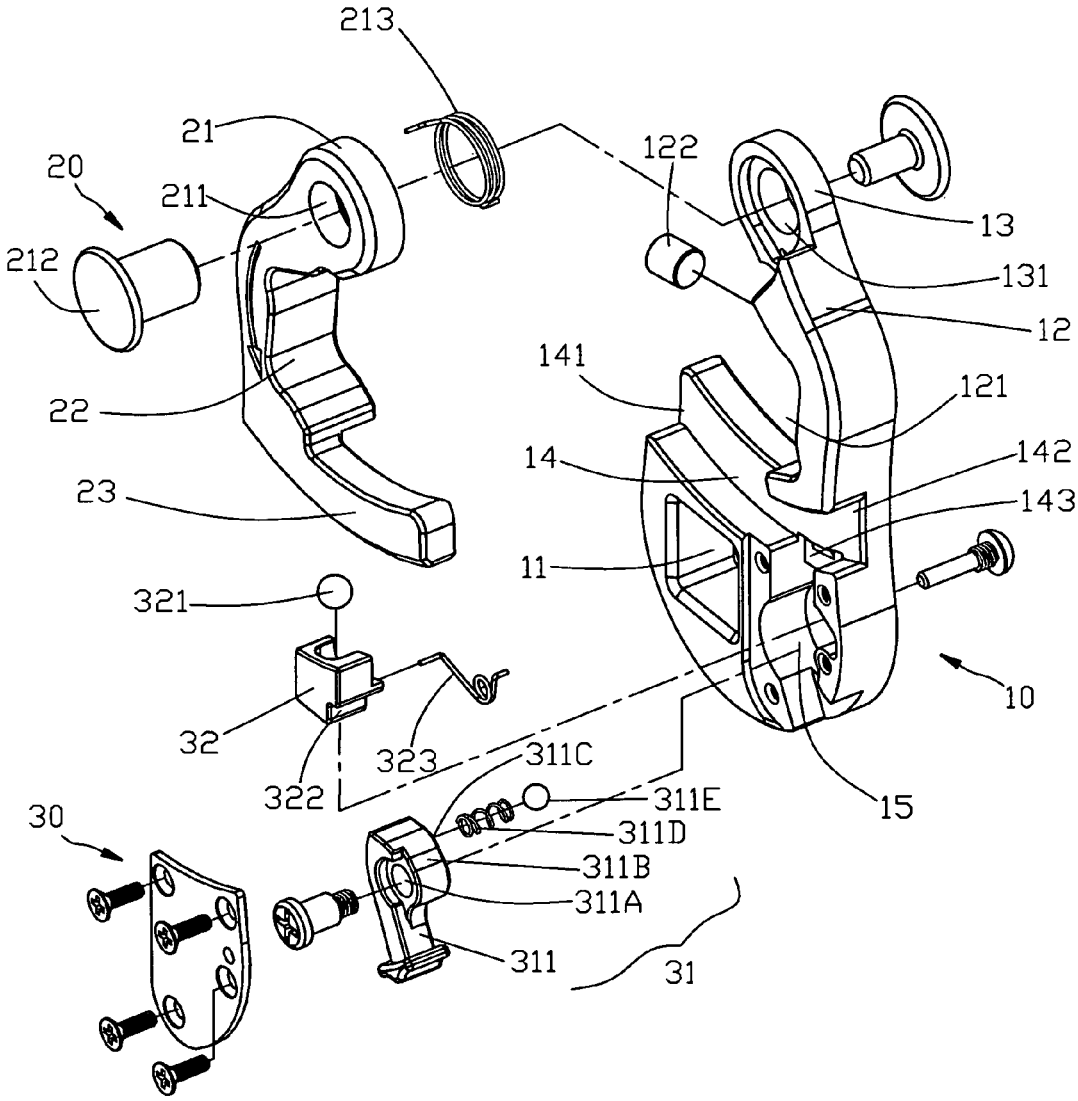
FIG. 1 is a perspective view showing the exploded components of an adjustable wrench according to a first embodiment of the present invention.
Figure 2:
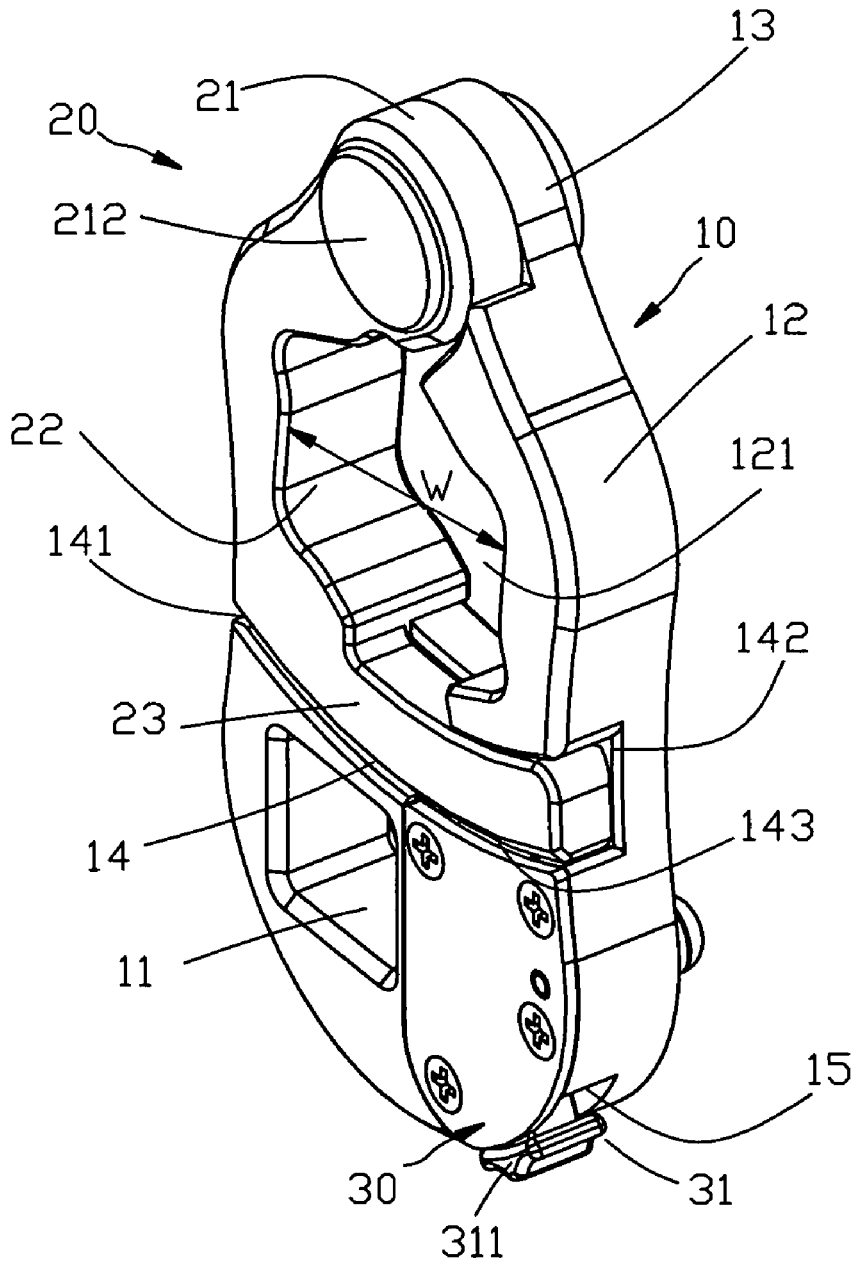
FIG. 2 is a perspective view showing the assembly of the adjustable wrench according to the first embodiment of the present invention.
Figure 5:
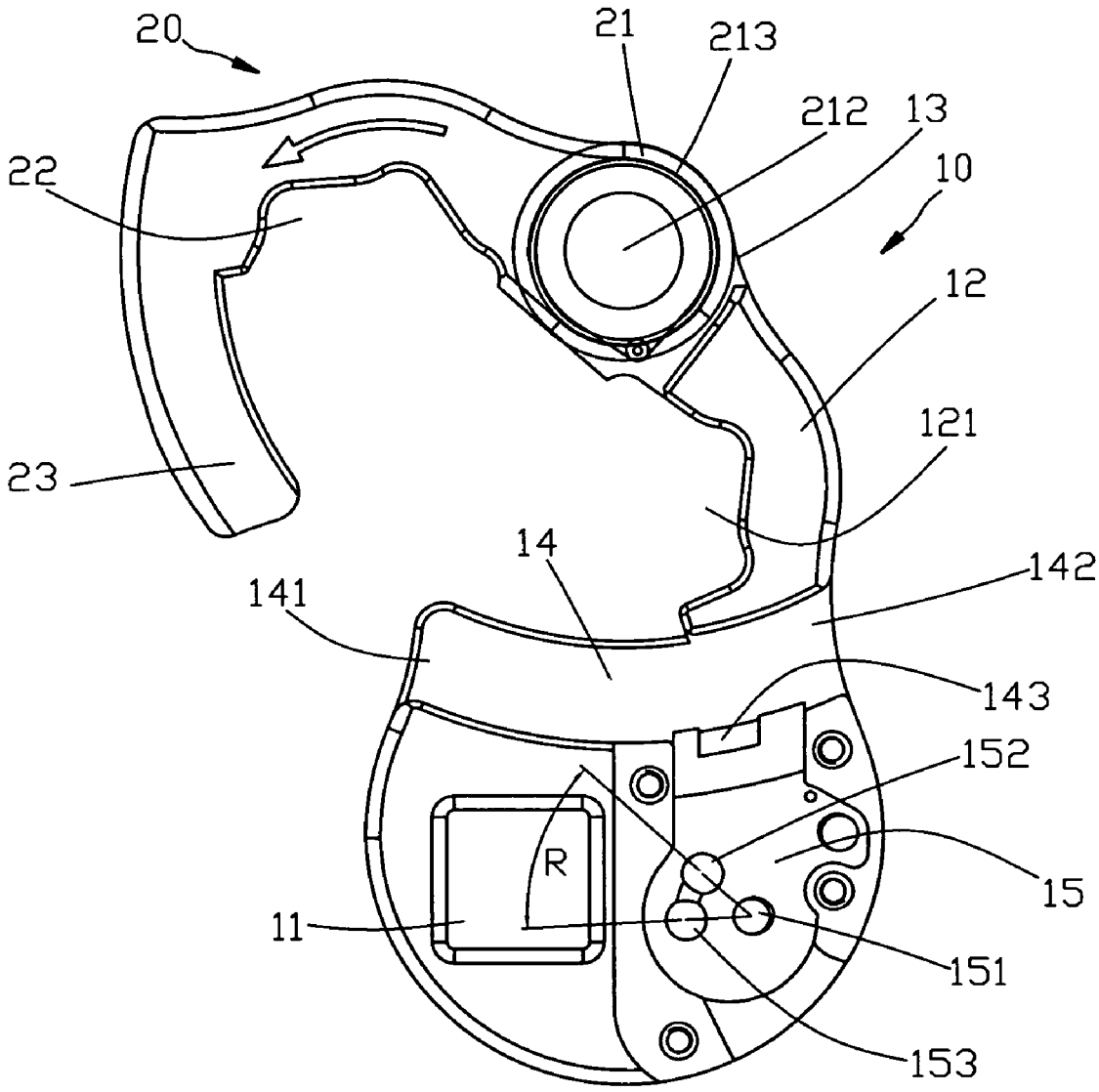
FIG. 5 is a plan view showing the assembly of a movable jaw and a body of the adjustable wrench according to the first embodiment of the present invention.

With reference to FIGS. 2 and 3, the movable jaw 20 is rotated to the arcuate recess 14 of the body 10, and the arcuate recess 14 is used to limit the guiding rib 23. Furthermore, a distance W between the first and second engaging surfaces 121, 22 is changed to engage and rotate different sizes of workpieces. Because the movable jaw 20 is pivoted in the holder 13 of the body 10, it can be rotated outward or inward (as shown in FIG. 5) so as to engage any sizes of workpieces, and the guiding rib 23 is limited in the arcuate recess 14 and then to be positioned by using the locking mechanism 30. As illustrate in FIG. 3, when the guiding rib 23 is moved to the outlet 142, the biasing ball 321 is actuated by the retaining plane 311B to move upward, so that the biasing ball 321 moves upward to position the guiding rib 23, and the magnet 122 of the first engaging surface 121 attracts the workpiece, enhancing engagement.

Figure 6:
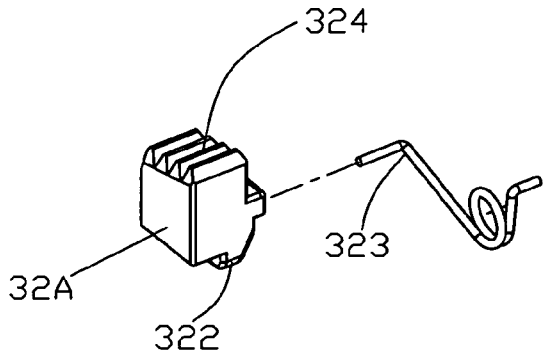
FIG. 6 is a perspective view showing the exploded components of a pushing member of an adjustable wrench according to a second embodiment of the present invention.
Figure 7:
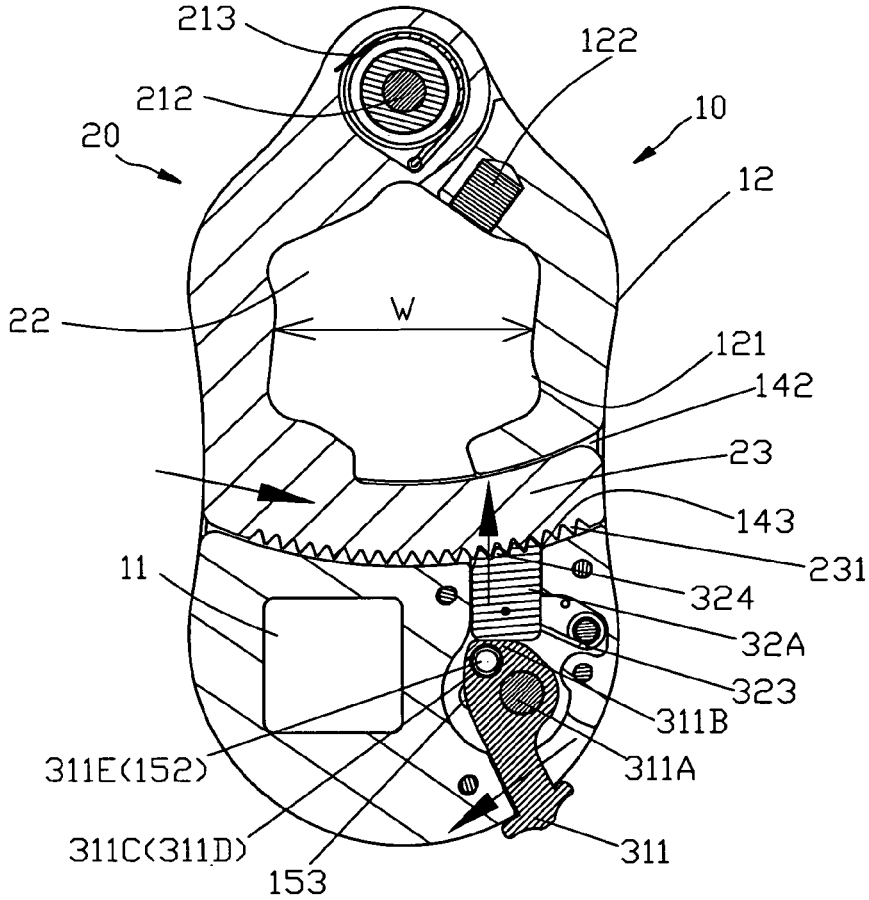
FIG. 7 is a perspective view showing the assembly of the pushing member of the adjustable wrench according to the second embodiment of the present invention.

As shown in FIGS. 6 and 7, to make the locking mechanism 30 retain the movable jaw 20 securely, an adjustable wrench according to a second embodiment of the present invention comprises a plurality of ratchet teeth 231 arranged on a lower end of the guiding rib 23. The actuating portion 322 of a pushing member 32A is pushed by the retaining plane 311B and the first resilient element 323, the pushing member 32A includes a number of positioning teeth 324 disposed on a top surface thereof to engaged with the ratchet teeth 231 of the guiding rib 23, such that when the levering member 311 is levered to move toward a locking position, the movement of ratchet teeth 231 of the guiding rib 23 is stopped.

Figure 8:
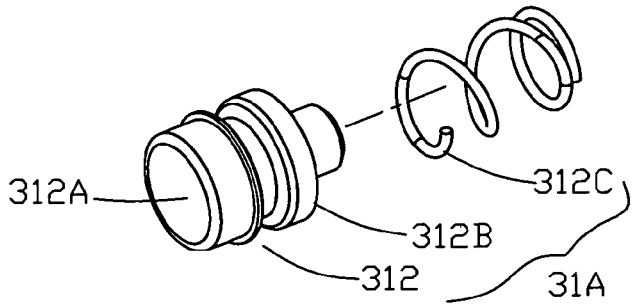
FIG. 8 is a perspective view showing the exploded components of a control unit of an adjustable wrench according to a third embodiment of the present invention.
Figure 9:
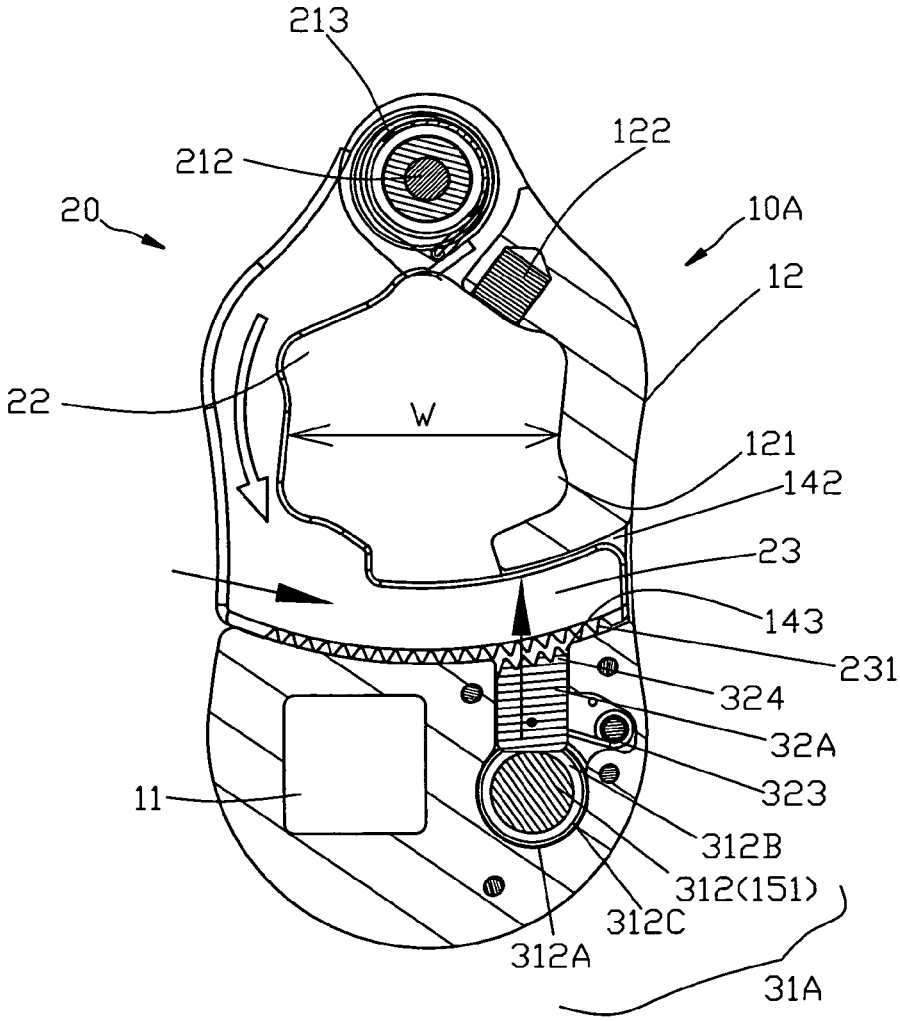
FIG. 9 is a cross sectional view showing the assembly of the control unit of the adjustable wrench according to the third embodiment of the present invention.
Figure 10:
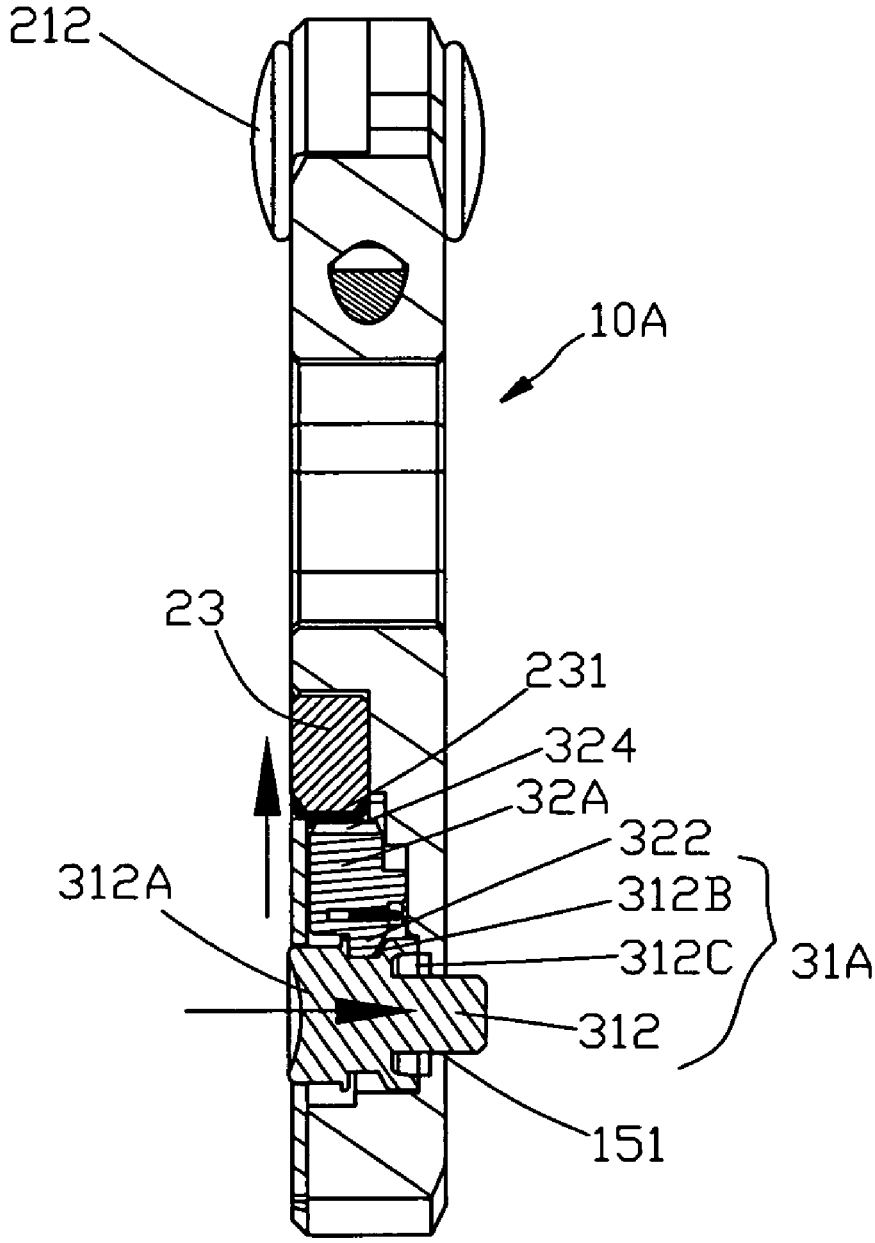
FIG. 10 is another cross sectional view showing the assembly of the control unit of the adjustable wrench according to the third embodiment of the present invention.

Referring to FIGS. 8-10, an adjustable wrench according to a third embodiment of the present invention comprises a body 10A including a through hole 11, a fixed jaw 12, a first engaging surface 121, a magnet 122, an arcuate recess 14, a notch 143, and a cavity 15. The cavity 15 includes an aperture 151 disposed at a central portion thereof to receive a control unit 31A of a locking mechanism 30 and a pushing member 32A, wherein a plurality of ratchet teeth 231 are arranged on a bottom end of the guiding member 23. With reference to FIG. 8, the control unit 31A is a press pillar 312 having a button 312A on a top end thereof, and the press pillar 312 also has an annular protrusion 312B with a tilted plane extending outward from a middle portion thereof, and a second resilient element 312C axially disposed on a bottom end thereof. The pushing member 32A of the locking mechanism 30 includes an actuating portion 322 with a beveled surface (as illustrated in FIGS. 6 and 10) to push against the tilted plane of the actuating portion 312B as the press pillar 312 is axially operated, and includes a first resilient element 323 fixed on an inner wall thereof to push the pushing member 32A. When the button 312A is pressed, the press pillar 312 actuates the actuating portion 312B to move axially and to abut against the actuating portion 322 of the pushing member 32A so that the positioning teeth 324 of the pushing member 32A moves upward to engage with the ratchet teeth 231 of the guiding rib 23. On the contrary, the button 312A is driven by the second resilient element 312C to move in an opposite direction, and then the press pillar 312 is guided by the actuating portion 322 of the pushing member 32 so that the positioning teeth 324 disengage from the ratchet teeth 231 of the guiding rib 23 by using the first resilient element 323.

While we have shown and described various embodiments in accordance with the present invention, it is clear to those skilled in the art that further embodiments may be made without departing from the scope of the present invention.

What is claimed is:

1. An adjustable wrench comprising:

a body used to operate the adjustable wrench and including a fixed jaw extending outward therefrom and having a polygonal first engaging surface formed on a lower side of the fixed jaw, and the fixed jaw also having a holder mounted on a top end thereof, the body further including an arcuate recess with an inlet and an outlet fixed on a middle portion of a front side thereof and with a notch proximate to the outlet, and including a cavity adjacent to the notch;

a movable jaw pivoted in the holder and including a polygonal second engaging surface formed on an inner wall thereof in response to the first engaging surface so as to engage a workpiece, and including a guiding rib relative to the arcuate recess extending from a bottom end thereof to be adjusted and moved along the arcuate recess;

a locking mechanism pivoted in the cavity of the body and including a control unit to operate the locking mechanism and to drive a pushing member, the control unit including locking and unlocking positions so as to move the pushing member across the notch of the arcuate recess and then to bias against the guiding rib, thereafter, the pushing member is driven to move downward, thus disengaging the guiding rib to slide freely.

2. The adjustable wrench as claimed in claim 1, wherein the body includes a through hole disposed on a lower side thereof.

3. The adjustable wrench as claimed in claim 1, wherein the control unit includes a levering member pivoted in the cavity and a retaining plane arranged around an outer side of a pivotal projection, the pushing member includes a biasing ball received therein, an actuating portion formed on a bottom side thereof to be pushed by the retaining plane, and a first resilient element retained therein, such that as the levering member is levered, the biasing ball of the pushing member is actuated to move across the notch of the arcuate recess and then to bias against the guiding rib.

4. The adjustable wrench as claimed in claim 1, wherein the first engaging surface includes at least one magnet attached therein.

5. The adjustable wrench as claimed in claim 1, wherein the cavity of the body includes an aperture secured at a central portion thereof and first and second limiting orifices disposed thereon so as to form a 45 degree angle between the first and second limiting orifices relative to the aperture, and the control unit also includes a pivotal projection pivoted in the aperture, the retaining plane arranged around an outer side of the pivotal projection, a positioning port relative to the first and second limiting orifices, a spring and a positioning ball.

6. The adjustable wrench as claimed in claim 1, wherein a plurality of ratchet teeth are arranged on a lower end of the guiding rib, and the pushing member includes a number of positioning teeth disposed on a top surface thereof to engage with the ratchet teeth of the guiding rib.

7. The adjustable wrench as claimed in claim 1, wherein the movable jaw is pivoted in the holder and includes an axial mount having a bore mounted on one end of the axial mount to receive a shaft member and a torsion spring.

8. An adjustable wrench comprising:

a body used to operate the adjustable wrench and including a fixed jaw extending outward therefrom and having a polygonal first engaging surface formed on a lower side of the fixed jaw, and the fixed jaw also having a holder mounted on a top end thereof, the body further including an arcuate recess with an inlet and an outlet fixed on a middle portion of a front side thereof and with a notch proximate to the outlet, and including a cavity adjacent to the notch;

a movable jaw pivoted in the holder and including a polygonal second engaging surface formed on an inner wall thereof in response to the first engaging surface so as to engage a workpiece, including a guiding rib relative to the arcuate recess extending from a bottom end thereof to be adjusted and moved along the arcuate recess;

a locking mechanism axially displacing in the cavity of the body and including a control unit to operate the locking mechanism and to drive a pushing member, the control unit being an axial mount and including locking and unlocking positions so as to move the pushing member across the notch of the arcuate recess and then to bias against the guiding rib, thereafter, the pushing member is driven to move downward, thus disengaging the guiding rib to slide freely.

9. The adjustable wrench as claimed in claim 8, wherein the guiding rib includes a plurality of ratchet teeth are arranged on a lower end thereof.

10. The adjustable wrench as claimed in claim 8, wherein the body includes a through hole disposed on a lower side thereof.

11. The adjustable wrench as claimed in claim 8, wherein the movable jaw is pivoted in the holder and includes an axial mount having a bore mounted on one end of the axial mount to receive a shaft member and a torsion spring.

* * * * *